US006024838A

United States Patent [19]

Van Haag et al.

[11] Patent Number: 6,024,838

[45] Date of Patent: Feb. 15, 2000

[54] CALENDER FOR PAPER AND THE LIKE

[75] Inventors: Rolf Van Haag, Kerken; Heinrich Stein, Moenchengladbach, both of Germany

[73] Assignee: Voith Sulzer Finishing GmbH, Krefeld, Germany

[21] Appl. No.: 08/825,346

[22] Filed: Mar. 28, 1997

[30] Foreign Application Priority Data

Apr. 6, 1996 [DE] Germany ..... 196 13 878

[51] Int. Cl.[7] ..... B30B 3/04

[52] U.S. Cl. ..... 162/361; 162/205; 162/252; 100/161; 100/163 A; 492/21

[58] Field of Search ..... 162/205, 206, 162/357, 361, 290, 252, 263, 358.3, 360.2; 100/161, 162 R, 165, 163 A, 169, 176; 492/21, 7

[56] References Cited

U.S. PATENT DOCUMENTS

| | | | |
|---|---|---|---|
| 4,556,454 | 12/1985 | Dahl et al. | 162/358 |
| 4,596,523 | 6/1986 | Whitehead . | |
| 4,747,195 | 5/1988 | Snellman | 29/116 R |
| 5,163,364 | 11/1992 | Bubik et al. | 100/38 |

FOREIGN PATENT DOCUMENTS

| | | |
|---|---|---|
| 10131076 | of 0000 | Japan . |
| 6032397 | of 0000 | Japan . |
| 61174494 | of 0000 | Japan . |
| 63-2598 | of 0000 | Japan . |
| 9501993 | of 0000 | Japan . |
| 60-181394 | 9/1985 | Japan . |

OTHER PUBLICATIONS

Voith Sulzer Papiertechnik, "Die Neue Softkalander–Generation" pp. 1–16 (1994).

*Primary Examiner*—Peter Chin
*Assistant Examiner*—Steven B. Leavitt
*Attorney, Agent, or Firm*—Greenblum & Bernstein P.L.C.

[57] ABSTRACT

A calender for a sheet material, e.g., paper, having at least two treatment stations through which the sheet material passes in succession. To regulate a desired parameter of the sheet material, each treatment station may include a plurality of adjacently arranged adjustment zones positioned in a row extending across a width of the sheet material. The adjustment zones of one of the treatment stations are positioned to be offset relative to the adjustment zones of the other treatment station by a fraction of a width of the adjustment zones, e.g., one-half the width. The particular arrangement enabling improved correction potential without increasing structural expenditure.

20 Claims, 3 Drawing Sheets

CALENDER FOR PAPER AND THE LIKE

CROSS-REFERENCE OF RELATED APPLICATION

The present invention claims the priority under 35 U.S.C. § 119 of German Patent Application No. 196 13 878.7 filed on Apr. 6, 1996.

BACKGROUND OF THE INVENTION

1. Field of the Invention

The present invention relates to a calender for a sheet material, e.g., paper, cardboard, film, and other similar sheet material, including at least two successive treatment stations through which the sheet material passes. To influence predetermined parameters of the sheet material, each treatment station includes a plurality of adjacently positioned adjustment zones at a predetermined spacing to form a row laterally extending across the sheet material substantially perpendicular to the travel direction of the sheet material. The adjustment zones of one treatment station may be offset with respect to the adjustment zones of the other treatment station.

The term "calender" as used herein may encompass roll devices for processing sheet materials, e.g., paper, cardboard, film, and other similar material. The processing may include, e.g., refining the sheet material with regard to thickness, gloss, smoothness, and other properties. Therefore, calender, in accordance with the present invention, may encompass compact calenders and super calenders that have "soft" work gaps, which may be defined on one side by a hard roll and on an other side by a roll provided with an elastic cover, and also may encompass smoothing calenders whose work gaps are defined on both sides by hard rollers.

2. Discussion of the Background Information

A calender generally related to the calender discussed above has been disclosed, e.g., in the pamphlet from Voith Sulzer Papiertechnik entitled "Die Neue Softkalander-Generation" [The New Generation of Soft-Calenders], published in November 1994. According to this pamphlet, a paper sheet is conducted through two work gaps, each work gap formed between a hard roll and a roll provided with an elastic cover. The elastic roll is a deflection adjustment roll with a multitude of adjusting members positioned adjacent to one another as support elements for the elastic roll cover. Each adjusting member exerts a predetermined pressure to the inside of the elastic cover against a driven hard roll.

Given the above-noted arrangement, several problems and drawbacks may occur. For example, for technological reasons, a width of individual zones, i.e., a predefined zone generally including one or more adjusting members actuated by a single control signal, should be as small as possible so that narrow regions of influence are produced and narrow width defects in the profile can be corrected. However, notwithstanding whether the zones include one adjusting member or a number of adjusting members, as the zones become narrower, the structural expenditure and the production costs become greater. Moreover, certain adjusting members, e.g., hydrostatic support elements, cannot be produced any smaller than a predetermined width.

SUMMARY OF THE INVENTION

An object of the present invention, therefore, is to provide a calender substantially similar to the calender of the prior art but which also includes an increased correction potential not available in the prior art and which may be maintained as a substantially similar structural expenditure as the prior art.

The present invention may achieve the above object by providing a pair of successive treatment stations, e.g., calender rolls, in which the adjustment zones of a second treatment station are offset in relation to the adjustment zones of the first treatment station by a fraction of the adjustment zone spacing.

The calender of the present invention may provide for correction of a lateral profile of a sheet material, e.g., thickness, gloss, smoothness, or the like, which may be distributed over two or more treatment stations. The present invention is concerned with the end result, i.e., the lateral profile of the final sheet material product. Because the adjustment zones of the treatment stations of the present invention are offset relative to each other, overlapping regions may be produced between the successive treatment stations that may have a narrower width than an individual adjustment zone, but which may be individually influenced. A further advantage of the present invention may be that within the lateral profile, transitions between adjacent adjustment zones may be better balanced than in the prior art.

According to the present invention, it may be particularly advantageous to offset the adjustment zones of the first and second treatment stations by one-half a space, i.e., approximately one-half a width of an individual adjustment zone. This feature effectively doubles the number of individually controllable regions available for processing the sheet material.

In a particular embodiment of the present invention, each adjustment zone may include an individually adjustable adjusting member. This embodiment, therefore, may produce extremely narrow regions that can be individually influenced.

In an alternative embodiment of the present invention, each adjustment zone may include two or more adjusting members that may be jointly adjusted. In this regard, in addition to the simplifications which may be realized by combining individual adjusting members into adjustment zones, the present invention may also individually correct certain regions which may be narrower than an individual adjustment zone width.

Each treatment station of the present invention may include a work gap formed between a pair of rolls, e.g., a deflection adjustment roll with a jacket pressable against another roll through a plurality of support elements. The support element may constitute adjusting members and may be acted upon with adjustable pressure. When a deflection adjustment roll is utilized, it may be particularly advantageous to work with narrow overlap regions in order to correct the lateral profile of the sheet material being processed. Due to the rigidity of the roll jacket, each change in a line load in a particular zone may also lead to undesired changes in adjacent zones. However, the present invention may reduce this effect by distributing the correcting data over two adjustment zones which may be passed in succession by the sheet material and which may be offset relative to each other.

As another advantage, the present invention may utilize two identical deflection adjustment rolls to form the work gaps. The deflection adjustment rolls may include a plurality of zones having two support elements and a zone located at one end having a single support element. Thus, the present invention may save storage space and money by requiring only a single reserve roll which may replace either deflection adjustment roll in the event of a defect or problem.

Alternatively, the present invention may utilize two deflection adjustment rolls having evenly distributed support elements to form the two work gaps. Further, the mounts carrying the deflection adjustment rolls may be offset in relation to one another.

A further advantage of the present invention may be that the jacket of the deflection adjustment roll may substantially be made of fiber-reinforced plastic. A jacket made of this material may be elastically deformed more easily than a cast iron or steel jacket. Thus, the jacket may better follow the deformations required for correcting the lateral profile. Further, the correction potential for the present invention may be increased.

As an alternative to the support elements discussed above, other types of adjusting members may also be utilized in the present invention. For example, inductive heating elements or hot or cold air blowers may be utilized. Thus, even though these alternative adjusting members generally have a particular minimum width, the present invention may enable for correction of a lateral profile within narrower regions than are available to the adjusting members used individually.

Another advantage of the present invention may be realized in that the treatment stations may be provided at two separately disposed pairs or stacks of rolls. Thus, the treatment stations may be completely separate from one another, which facilitates the control of each individual adjusting member (or adjustment zone).

Another feature of the present invention may be realized by providing a deflection adjustment roll in a one of the treatment stations that may be axially movable with respect to the other deflection adjustment roll of the other treatment station. The axial adjustment enables regulation of the lateral profile of the sheet material being processed.

The present invention may be directed to a calender for a sheet material that may include a first and second treatment station through which the sheet material successively passes. Each treatment station may include a plurality of adjacent adjustment zones having a predetermined width and may be positioned in a row extending laterally to a travel direction of the sheet material. The adjustment zones of the second treatment station may be offset relative to the adjustment zones of the first treatment station by a fraction of the predetermined width.

In accordance with a further feature of the present invention, the adjustment zones of the second treatment station may be offset relative to adjustment zones of the first treatment station by one-half the predetermined width.

In accordance with a further feature of the present invention, each adjustment zone may include a single, individually adjustable adjusting member.

In accordance with a still further feature of the present invention, each adjustment zone may include at least two, jointly adjustable adjusting members.

In accordance with yet another feature of the present invention, each treatment station may include a work gap formed between a first and second roll. The first roll may include a deflection adjustment roll including a jacket and the plurality of adjustment zones and each adjustment zone may include at least one adjusting member actuatable to adjustably press the jacket against the second roll.

In accordance with a further feature of the present invention, the deflection adjustment rolls of the first and second treatment stations may further include substantially identical deflection adjustment rolls forming the work gaps, and may include an edge adjustment zone. Each adjustment zone may include two adjusting members and the edge adjustment zone may include a single support element, positioned at an extreme end of the row of adjustment zones.

In accordance with still another feature of the present invention, the deflection adjustment roll may include evenly distributed adjusting members and an adjustable mount associated with at least one of the deflection adjustment rolls to offset the first treatment station with respect to the second treatment station.

In accordance with another feature of the present invention, the jacket of the deflection adjustment roll may include fiber-reinforced plastic.

In accordance with a further feature of the present invention, the adjusting members may include inductively functioning heating elements. Alternatively, the adjusting members may include at least one of hot and cold air blowers.

In accordance with another feature of the present invention, the first and second treatment stations may be located on two separately disposed stacks of rolls.

In accordance with a still further feature of the present invention, the first treatment station may include a deflection adjustment roll and the second treatment station may include a second deflection adjustment roll. The first deflection adjustment roll may be axially movable relative to the second deflection adjustment roll to regulate a lateral profile of the sheet material.

The present invention may be directed to a calender for regulating a predetermined parameter of a sheet material that may include a first plurality of adjustment zones adjacently positioned in a row traversing a width of the sheet material and a second plurality of second adjustment zones adjacently positioned in a row substantially parallel to the first plurality of adjustment zones. Each adjustment zone may be individually actuatable and may include a predetermined width. The first plurality of adjustment zones may be arranged to be offset, in a travel direction of the sheet material, from the second plurality of adjustment zone by an amount less than the predetermined width.

In accordance with another feature of the present invention, the calender may further include a first deflection adjustment roll including the first plurality of adjustment zones and a second deflection adjustment roll including the second plurality of adjustment zones. At least one of the first and second deflection adjustment rolls may be axially movable to offset the first plurality of adjustment zones from the second plurality of adjustment rolls.

In accordance with another feature of the present invention, the calender may further include a first deflection adjustment roll including the first plurality of adjustment zones and a first adjustment end zone located at one end of the row of the first plurality of adjustment zones and a second deflection adjustment roll including the second plurality of adjustment zones and a second adjustment end zone located at one end of the row of the second plurality of adjustment zones. Each adjustment zone may include two adjusting members and each adjustment end zone may include one adjusting member. The first and second deflection adjustment rolls may be substantially similar and may be mounted so that the first adjustment end zone and the second adjustment end zone are located at opposite ends of the first plurality of adjustment zones and the second plurality of adjustment zones. Further, each adjustment zone may be individually actuatable to jointly actuate the two adjusting members and each adjustment end zone may be individually actuatable to individually actuate the one adjusting member.

In accordance with still another feature of the present invention, each adjustment zone may be individually actuatable and may include at least one adjusting member.

In accordance with a further feature of the present invention, each adjustment zone may include one adjusting member and each of the first plurality of adjustment zones may by offset from each of the second plurality of adjustment zones by approximately one-half the predetermined width.

In accordance with yet another feature of the present invention, the calender may further include a regulator for receiving a predetermined desired parameter for the sheet material to be regulated and may forward a signal to individual adjustment zones to adjust the sheet material in accordance with the desired predetermined parameter. The calender may also include a first sensor, coupled to the regulator, for monitoring the sheet material before adjustment and a second sensor, coupled to the regulator, for monitoring the sheet material after adjustment by the first and second pluralities of adjustment zones.

Further embodiments and advantages can be seen from the detailed description of the present invention and the accompanying figures.

BRIEF DESCRIPTION OF THE DRAWINGS

The present invention is further described in the detailed description which follows, in reference to the noted drawings by way of non-limiting examples of preferred embodiments of the present invention, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
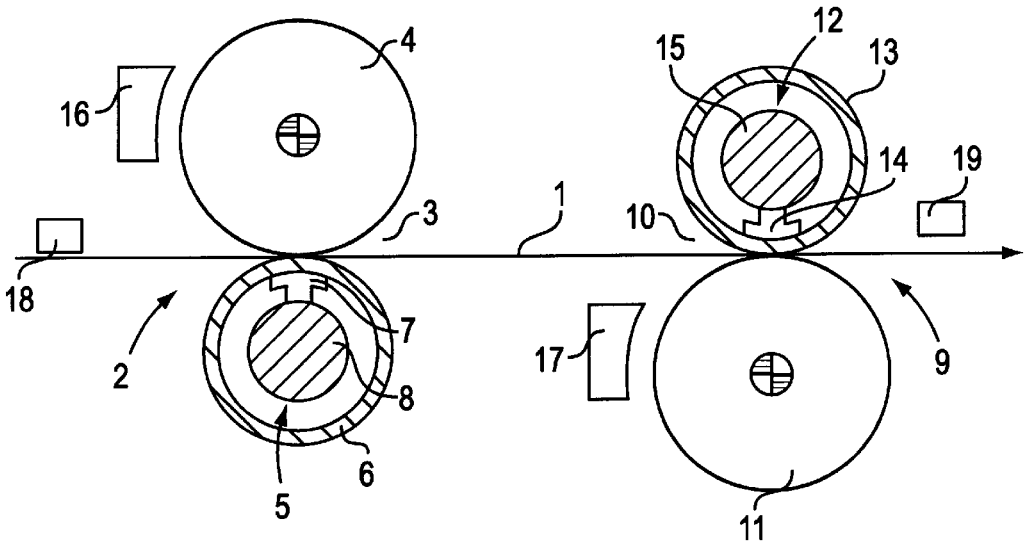
FIG. 1 illustrates a simplified side view of a system for controlling a lateral profile of a sheet material utilizing a calender.

FIG. 1 illustrates a calender for refining a sheet material 1, e.g., paper, cardboard, film, or other similar material. A first treatment station 2 may include a soft work gap 3 formed between a driven hard roll 4 and a soft roll 5. Soft roll 5 may include a deflection adjustment roll having a roll jacket 6 that may be supported on a carrier 8 by a plurality of adjacently positioned adjusting members 7, e.g., hydrostatic support elements. Jacket 6 may be formed of a material including a fiber-reinforced plastic. A second treatment station 9 may include a soft work gap 10 formed by a driven hard roll 11 and a soft roll 12. Soft roll 12 may also include a deflection adjustment roll having a jacket 13, made of a material comprising fiber-reinforced plastic, that may be supported on a stationary carrier 15 by a plurality of adjacently positioned adjusting members 14, e.g., hydrostatic support elements. Further, each treatment station 2 and 9 may be associated with an inductive heating device 16 and/or 17, which may also include a plurality of series of adjusting members positioned adjacent to one another. Alternatively, a series of cold or hot air blowers may be utilized for the inductive heating devices.

Figure 2:
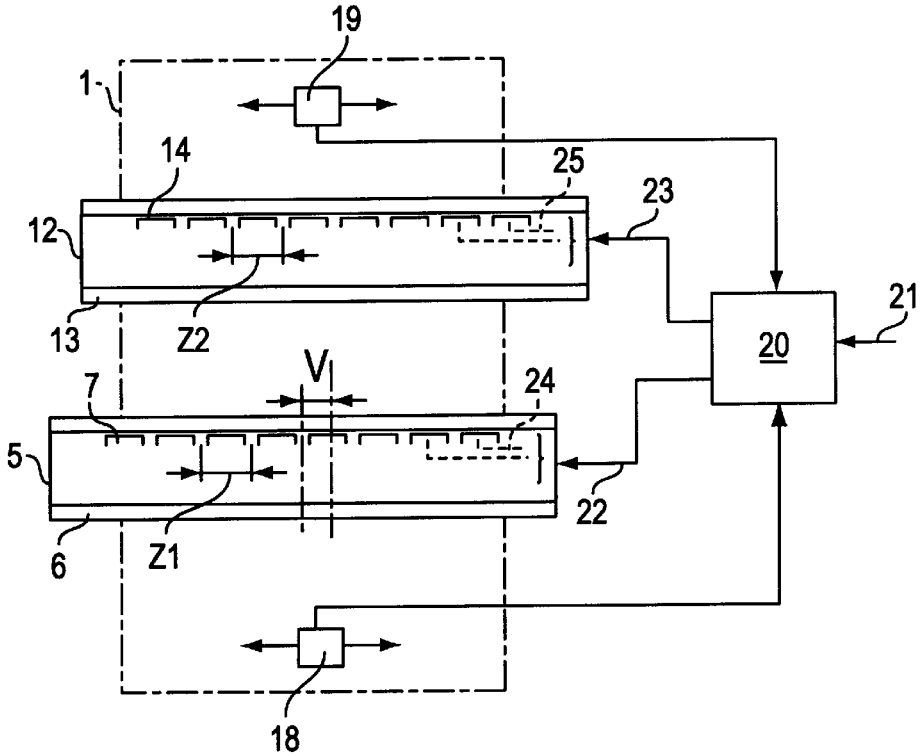
FIG. 2 illustrates a schematic representation of the calender depicted in FIG. 1.

A sensor 18 may be located above a sheet material 1 and prior to entry into first treatment station 2. Sensor 18 may traverse, i.e., move back and forth across, the surface of sheet material 1, as shown, e.g., in FIG. 2. A second sensor 19 may also be located above sheet material 1, however, after the sheet material exits second treatment station 9. Second sensor 19 may also traverse the width of the sheet material surface, as shown, e.g., in FIG. 2. These sensors may be utilized to measure particular predetermined parameters of sheet material 1, e.g., thickness, gloss, smoothness, etc. Measurement signals may be transmitted to a regulator 20, which may include an input 21 for a predetermined lateral profile set point, e.g., a value related to a desired sheet thickness. Regulator 20 may also include two outputs 22 and 23, which provides a signal to exert a pressure on the individual adjusting members 7 and 14 against jacket 6 and 13, respectively, through individual pressure lines 24 and 25 (shown in dashed lines). While only eight adjusting members 7 and 14 are shown in FIG. 2, it is noted that any number of adjusting members may be utilized to span the width of sheet material 1. When each adjusting member is individually adjustable, relatively small adjustment zones Z1 and Z2 may result. For example, adjustment zone Z1 may be located to include the entire width of adjustable member 7, e.g., approximately 15 to 30 cm, and one-half of the space existing between adjusting member 7 and each adjacent adjustable members.

As shown in FIG. 2, the two rolls 5 and 12 may be identically constructed, but may be offset relative to each other by an amount V, which may correspond to offsetting one roll, with respect to the other, by one-half of an adjustment zone. Thus, as shown in exemplary FIG. 2, a mid-point of the space between two adjusting members 14 may correspond with a mid-point of an adjusting member 7 in a travel direction of sheet material 1. As a result, narrow regions of sheet material 1, which correspond to the area indicated in the figure as offset V, may be individually influenced by the calender even though the individual widths of the individual adjustment zones Z1 and Z2 may be greater than the offset area V.

Figure 3A:
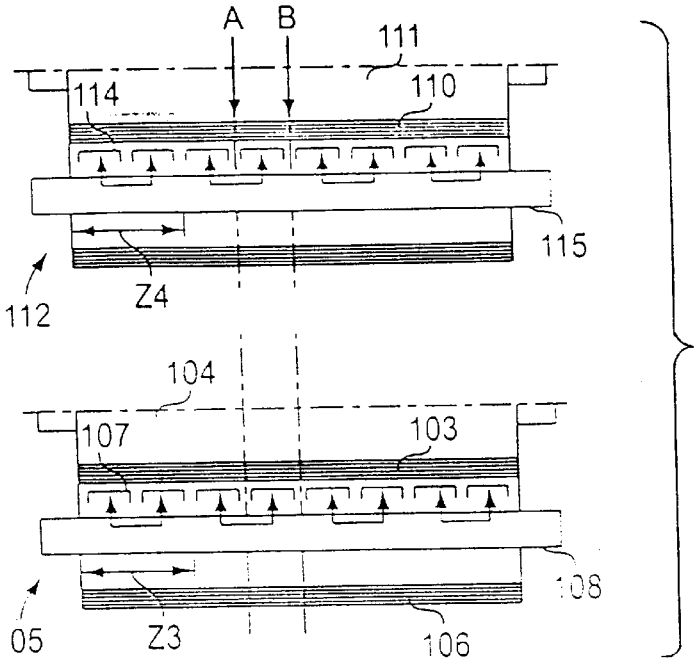
FIG. 3A PRIOR ART
FIGS. 3A–3C illustrates a schematic representation of a known calender and a line load that is produced by individual adjustment zones.

FIG. 3A illustrates a prior art type calender similar in general to the calender of the present invention. The prior art shows identical rollers 105 and 112 which include a plurality of adjusting members 107 or 114. Adjacent adjusting members 107 and 114 may be grouped into pairs to form a common controllable adjustment zone Z3 or Z4. Adjusting members 107 are arranged to be aligned with adjusting members 114 and adjustment zone Z3 is arranged to be aligned with adjustment zone Z4 with respect to the travel direction of sheet material 1.

Figure 3B:
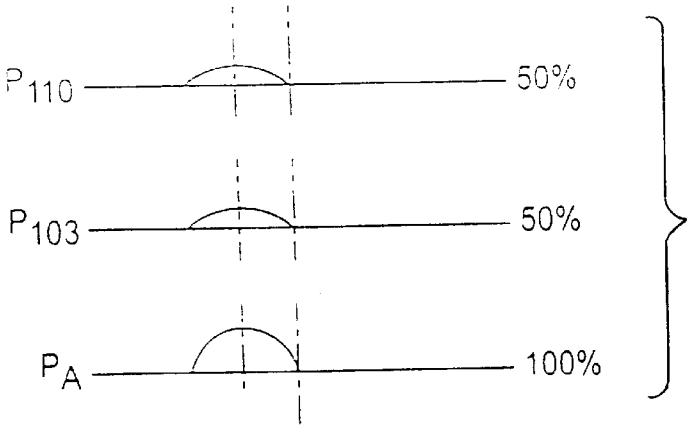
FIG. 3B PRIOR ART

Assume that an increased line load (or exerted pressure) is desired at the center of an adjustment zone, e.g., at arrow A. A pressure increase may be performed in successive adjustment zones Z3 and Z4 against roll jackets 103 and 110, respectively. That is, as shown in FIG. 3B, the lateral profile of the sheet material at point A may be adjusted or corrected in a two-step process, i.e., 50% correction by the first treatment station and the remaining 50% correction by the second treatment station. Thus, effective curves $P_{103}$ and $P_{110}$ may be produced to show the 50% pressure correction exerted by the corresponding adjustment zones Z3 and Z4 against covers 103 and 110, respectively, to correct the lateral profile at point A of the sheet material. Thus, an effective curve $P_A$ may be obtained which indicates the entire correction pressure exerted and which is substantially the same width as an adjustment zone.

Figure 3C:
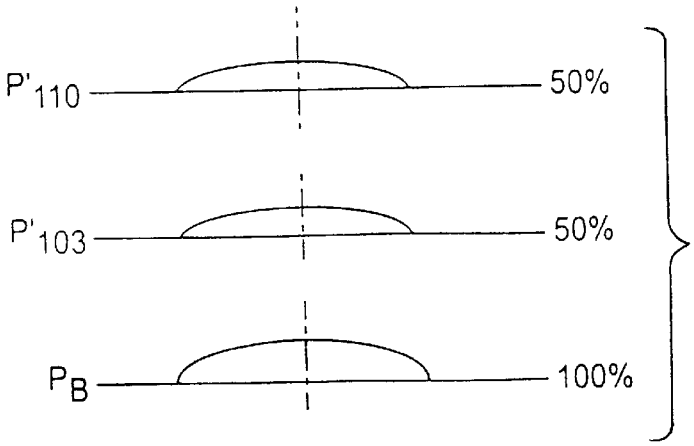
FIG. 3C PRIOR ART

Alternatively, assume that an increase in exerted pressure is desired at a point located between adjacent adjustment zones, e.g., at arrow B. The adjustment zones that are positioned adjacent to each other and adjacent to the point indicated by arrow B must be actuated to provide pressure to effect a correction of the lateral profile of the sheet material. That is, as shown in FIG. 3C, a 50% effective curve may again be associated with each treatment station, however, pressure must be exerted by each adjustment zone adjacent point B to be corrected against covers 103 and 110. Thus, 50% effective curve $P'_{103}$ indicates the pressure applied by both adjacent adjustment zones, i.e., four adjusting members 107, of the first treatment station against cover 103 and 50% effective curve $P'_{110}$ indicates the pressure applied by both adjacent adjustment zones, i.e., four adjusting members 114, of second treatment station against cover 110. Therefore, the combination of 50% effective curves $P'_{103}$ and $P'_{110}$ produces effective curve $P_B$, which has a width equivalent to the width of two adjustment zones, which is too large for sensitive regulation.

Figure 4A:
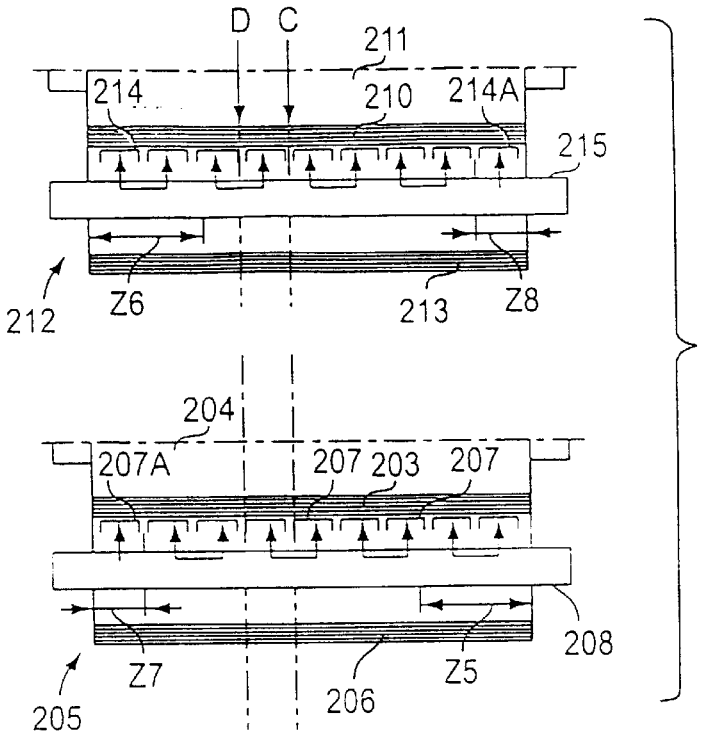
FIGS. 4A–4C illustrates a schematic representation of an alternative embodiment of a calender according to the present invention and the line load that may be produced by individual adjustment zones.

In accordance with another embodiment of the present invention, the above-noted drawbacks of the prior art depicted in FIG. 3A may be avoided. In the arrangement of the alternative embodiment of FIG. 4A, two identical deflection adjustment rolls may be utilized, however, the specific positioning of one of the rolls, e.g., roll 212, may be reversed with respect to the other roll, e.g., roll 205. Each roll may include a plurality of adjustment zones Z5 and Z6 which may include a grouped pair of adjacent adjusting members 207 or 214, i.e., similar to the prior art arrangement, and a single short (end) zone, Z7 or Z8, which may include an individual adjusting member 207*a* or 214*a*. Thus, by the specific positioning of the rolls being reversed with respect to each other, the short zones Z7 and Z8 are located at opposite ends of the deflection adjustment rolls 205 and 212, respectively, of the respective successively located treatment stations. Accordingly, the adjustment zones within respective deflection adjustment rolls of the successive treatment stations may be offset relative to each other by one-half of an adjustment zone or substantially by the width of an individual adjusting member.

Figure 4B:
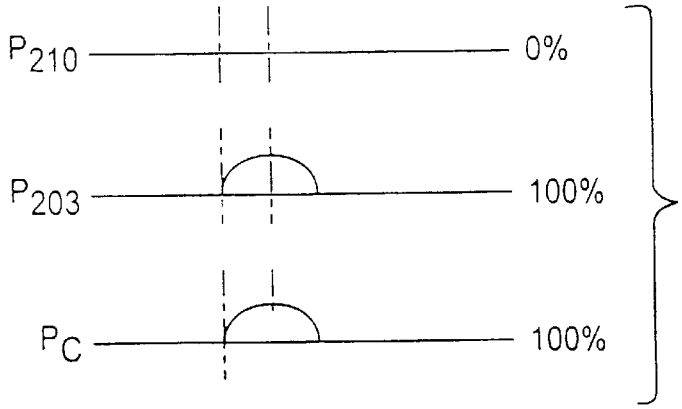
Figure 4C:
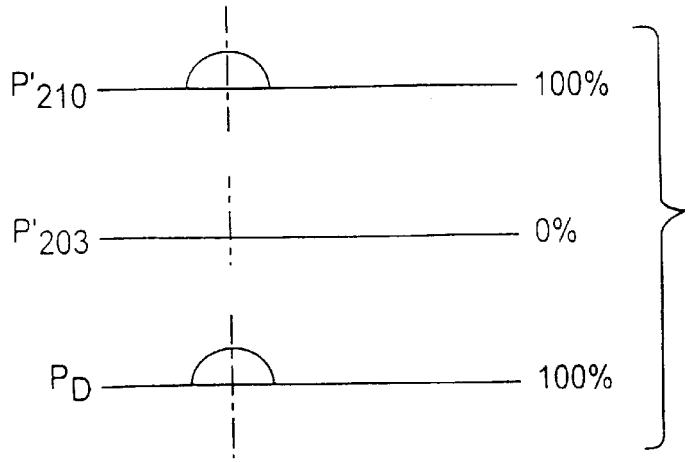

Thus, in contrast to the prior art, assume pressure is to be exerted at a desired region located between two adjustment zones of roll 212, e.g., at arrow C. The entire correction may be carried out by pressure exerted by adjustment zone Z5 in the first treatment station corresponding with location C. Thus, According to the present invention, it may be sufficient to exert pressure only in the first treatment station to perform a full correction or regulation of the predetermined parameter of the sheet material. For example, as shown by effective curve $P_{203}$ in FIG. 4B, exertion of the entire amount of pressure necessary to press adjustment zone Z5 (associated with point C) against cover 203 effects the desired correction of the predetermined parameter of the sheet material, while no further pressure is necessarily exerted by the adjustment zones Z6 adjacent point C against cover 210, as shown by effective curve $P_{210}$. Thus, as shown in FIG. 4C the desired overall effective curve $P_C$ may be substantially the same as effective curve $P_{203}$.

Alternatively, if a maximum correction effect is intended to occur at a point that is offset by one-half an adjustment zone from point C, e.g., at arrow D, the entire effect may be exhibited solely by exerting pressure at adjustment zone Z6 against cover 210 of the second treatment station. Thus, an effective curve $P'_{210}$ may be substantially identical to the desired overall effect $P_D$. Further, no additional exertion of pressure is necessitated within treatment station 1, as shown by effective curve $P'_{203}$, to effect the entire correction amount for the desired parameter, e.g., lateral profile, of the sheet material. Therefore, in accordance with this alternative embodiment of the present invention, influence or pressure may be individually exerted on sheet material 1 in narrow regions to produce an even end product.

Similar considerations may also be made when utilizing alternative adjusting members, e.g., hot and cold air blowers or inductive heating devices. In another alternative, the calender may include more than two treatment stations. While the present disclosure shows embodiments in which the second treatment station is carried out in a work gap that is separate from the first treatment station, the present invention may alternatively provide succeeding treatment stations in a common roll stack whose upper and lower rolls comprise deflection adjustment rolls.

In another alternative, roll 12 may be positionally offset relative to roll 5 through placement in a calender mount in which roll 12 may be laterally offset with respect to roll 5. It is also contemplated that the calender mount may be adjustable so as to further change or adjust the magnitude of the offset between rolls 5 and 12 during operation. Such an adjustment of the magnitude of the relative offset between the rolls may provide an additional regulating parameter.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A calender for a sheet material comprising:

a first and second treatment station through which the sheet material successively passes;

each treatment station comprising a plurality of adjacent adjustment zones having a predetermined width and positioned in a row extending laterally to a travel direction of the sheet material; and the adjustment zones of the second treatment station being offset relative to the adjustment zones of the first treatment station by a fraction of the predetermined width.

2. The calender according to claim 1, the adjustment zones of the second treatment station being offset relative to adjustment zones of the first treatment station by one-half the predetermined width.

3. The calender according to claim 1, each adjustment zone comprising a single, individually adjustable adjusting member.

4. The calender according to claim 1, each adjustment zone comprising at least two, jointly adjustable adjusting members.

5. The calender according to claim 1, each treatment station comprising a work gap formed between a first and second roll;

the first roll comprising a deflection adjustment roll including a jacket and the plurality of adjustment zones; and each adjustment zone comprising at least one adjusting member actuatable to adjustably press the jacket against the second roll.

6. The calender according to claim 5, the deflection adjustment rolls of the first and second treatment stations further comprising substantially identical deflection adjustment rolls forming the work gaps, including an edge adjustment zone;

each adjustment zone comprising two adjusting members; and the edge adjustment zone comprising a single support element, positioned at an extreme end of the row of adjustment zones.

7. The calender according to claim 5, the deflection adjustment roll comprising evenly distributed adjusting members; and an adjustable mount associated with at least one of the deflection adjustment rolls to offset the first treatment station with respect to the second treatment station.

8. The calender according to claim 5, the jacket of the deflection adjustment roll comprising fiber-reinforced plastic.

9. The calender according to claim 1, the adjusting members comprising inductively functioning heating elements.

10. The calender according to claim 1, the adjusting members comprising at least one of hot and cold air blowers.

11. The calender according to claim 1, the first and second treatment stations are located on two separately disposed stacks of rolls.

12. The calender according to claim 1, the first treatment station comprising a deflection adjustment roll and the second treatment station comprising a second deflection adjustment roll; and the first deflection adjustment roll being axially movable relative to the second deflection adjustment roll to regulate a lateral profile of the sheet material.

13. A calender for regulating a predetermined parameter of a sheet material comprising:

a first plurality of adjustment zones adjacently positioned in a row traversing a width of the sheet material; and a second plurality of second adjustment zones adjacently positioned in a row substantially parallel to said first plurality of adjustment zones;

each adjustment zone being individually actuatable and comprising a predetermined width; and said first plurality of adjustment zones arranged to be offset, transversely to a travel direction of the sheet material, from said second plurality of adjustment zone by an amount less than said predetermined width.

14. The calender according to claim 13, further comprising:

a first deflection adjustment roll comprising the first plurality of adjustment zones;

a second deflection adjustment roll comprising the second plurality of adjustment zones;

at least one of said first and second deflection adjustment rolls being axially movable to offset the first plurality of adjustment zones from said second plurality of adjustment rolls.

15. The calender according to claim 13, further comprising:

a first deflection adjustment roll comprising the first plurality of adjustment zones and a first adjustment end zone located at one end of said row of the first plurality of adjustment zones;

a second deflection adjustment roll comprising the second plurality of adjustment zones and a second adjustment end zone located at one end of said row of the second plurality of adjustment zones;

each adjustment zone comprising two adjusting members;

each adjustment end zone comprising one adjusting member; and said first and second deflection adjustment rolls being substantially similar and mounted so that said first adjustment end zone and said second adjustment end zone are located at opposite ends of said first plurality of adjustment zones and said second plurality of adjustment zones.

16. The calender according to claim 15, each adjustment zone being individually actuatable to jointly actuate said two adjusting members; and each adjustment end zone being individually actuatable to individually actuate said one adjusting member.

17. The calender according to claim 13, each adjustment zone being individually actuatable and comprising at least one adjusting member.

18. The calender according to claim 17, each adjustment zone comprising one adjusting member; and each said first plurality of adjustment zones being offset from each said second plurality of adjustment zones by approximately one-half said predetermined width.

19. The calender according to claim 13, further comprising a regulator for receiving a predetermined desired parameter for the sheet material to be regulated;

said regulator forwarding a signal to individual adjustment zones to adjust the sheet material in accordance with said desired predetermined parameter.

20. The calender according to claim 19, further comprising a first sensor, coupled to said regulator, for monitoring the sheet material before adjustment and a second sensor, coupled to said regulator, for monitoring the sheet material after adjustment by said first and second pluralities of adjustment zones.

* * * * *